US007600316B2

(12) United States Patent
Oswald

(10) Patent No.: US 7,600,316 B2
(45) Date of Patent: Oct. 13, 2009

(54) HEAT EXCHANGER AND A METHOD OF MANUFACTURING A HEAT EXCHANGER

(75) Inventor: James I Oswald, Hinckley (GB)

(73) Assignee: Rolls-Royce plc, London (GB)

( * ) Notice: Subject to any disclaimer, the term of this patent is extended or adjusted under 35 U.S.C. 154(b) by 368 days.

(21) Appl. No.: 11/342,974

(22) Filed: Jan. 31, 2006

(65) Prior Publication Data

US 2006/0283582 A1 Dec. 21, 2006

Related U.S. Application Data

(63) Continuation of application No. PCT/GB2004/003089, filed on Jul. 16, 2004.

(30) Foreign Application Priority Data

Aug. 12, 2003 (GB) ..... 0318838.0

(51) Int. Cl.

| | |
|---|---|
| ***B21D 51/16*** | (2006.01) |
| ***B21D 53/00*** | (2006.01) |
| ***B23P 15/26*** | (2006.01) |
| ***F23L 15/02*** | (2006.01) |
| ***F28D 7/02*** | (2006.01) |
| ***F28F 1/14*** | (2006.01) |

(52) U.S. Cl. ..... 29/890; 29/890.039; 29/726.5; 29/727; 165/8; 165/165; 165/184

(58) Field of Classification Search ..... 165/8, 165/10, 163–165, 184, 909; 29/726.5, 727, 29/890.03, 890.034, 890.039; 242/444.1
See application file for complete search history.

(56) References Cited

U.S. PATENT DOCUMENTS 2,879,979 A * 3/1959 Wheeler ..... 261/92

(Continued)

FOREIGN PATENT DOCUMENTS

EP 0 239 490 A 9/1987

(Continued)

*Primary Examiner*—David P Bryant
*Assistant Examiner*—Alexander P Taousakis
(74) *Attorney, Agent, or Firm*—Jeffrey S. Melcher; Manelli Denison & Selter PLLC

(57) ABSTRACT

A heat exchanger (10) comprises a first sheet (12), a second sheet (14) and an additional sheet (30). The first and second sheets (12, 14) are wound around an axis (X), each sheet (12, 14) has hot and cold edges at the hot and cold ends (16, 18) respectively of the heat exchanger (10). The hot and cold edges of the first sheet (12) are joined to the hot and cold edges of the second sheet (14). The end (12A) of the first sheet (12) is joined to the second sheet (30) by an axially extending join (28) at a position spaced from the end (14A) of the second sheet (14). The end (30A) of the additional sheet (30) is joined to the end (14A) of the second sheet (14) by an axially extending join (28). The additional sheet (30) is thicker and wider than the first and second sheets (12, 14) such that at least one of the hot and cold edges (30C, 30D) of the additional sheet (30) extend beyond the hot and cold edges of the first and second sheets (12, 14). The additional sheet (30) is wound around the first and second sheets (12, 14) about the axis (X) and the end (30B) of the additional sheet (30) is joined to the additional sheet (30) by an axially extending join (34).

18 Claims, 5 Drawing Sheets

U.S. PATENT DOCUMENTS 3,412,787 A * 11/1968 Muligan ..... 165/153
3,444,925 A * 5/1969 Johnson ..... 165/166
4,124,069 A * 11/1978 Becker ..... 165/164
4,172,312 A * 10/1979 Costick et al. ..... 29/890.034
4,203,205 A * 5/1980 Jouet ..... 29/727
4,503,902 A * 3/1985 Zolik ..... 165/47
5,797,449 A 8/1998 Oswald
6,115,919 A * 9/2000 Oswald et al. ..... 29/890.039
6,585,034 B2 7/2003 Oswald
6,789,616 B2 * 9/2004 Nakano ..... 165/167
7,191,824 B2 * 3/2007 Wu et al. ..... 165/141

FOREIGN PATENT DOCUMENTS

EP 0 380 419 A 8/1990
EP 0 753 712 A 1/1997
EP 0 798 527 A 10/1997
GB 0 931 096 7/1963
GB 2 109 525 A 6/1983
GB 2 372 559 A 8/2002

* cited by examiner

HEAT EXCHANGER AND A METHOD OF MANUFACTURING A HEAT EXCHANGER

This is a continuation of International Application Number PCT/GB2004/003089 filed Jul. 16, 2004, designating the United States.

FIELD OF THE INVENTION

The present invention relates to a heat exchanger and in particular to a plate fin heat exchanger or a primary surface heat exchanger.

BACKGROUND OF THE INVENTION

Plate fin heat exchangers generally comprise a plurality of plates and a plurality of fins extend between and may be secured to each adjacent pair of plates. The fins may be secured to the plates by brazing, welding, diffusion bonding etc. Alternatively the fins may not be secured to the plates. The fins are defined by corrugated plates. In plate fin heat exchangers the fins define the passages for the flow of fluids to be put into heat exchange relationship.

Primary surface heat exchangers generally comprise a plurality of plates and a plurality of spacers extend between each adjacent pair of plates to separate the plates. In primary surface heat exchangers the plates define passages for the flow of fluids to be put into heat exchange relationship.

Gas turbine engines comprise a compressor, a combustion chamber and a turbine arranged in flow series. The compressor compresses air and supplies it to the combustion chamber. Fuel is burnt in air in the combustion chamber to produce hot gases, which drive the turbine. The turbine drives the compressor and also drives a generator, a pump, a shaft or other load.

Heat exchangers are used in industrial gas turbine engines to return heat from the hot gases leaving the gas turbine engine to the compressed air leaving the compressor before it enters the combustion chamber. These heat exchangers are also known as recuperators, or regenerators. The recuperator heat exchanger increases the efficiency of the gas turbine engine and the hotter the air entering the combustion chamber the greater is the fuel saving.

The use of a spiral heat exchanger for a gas turbine engine recuperator is known from our European patent EP0753712B1 and this may be a plate fin type heat exchanger or a primary surface type heat exchanger.

A spiral heat exchanger, for example, is manufactured from two sheets of metal, which are wound together into a spiral and the edges of the sheets of metal are joined together. The sheets of metal may be stainless steel for low temperature spiral heat exchangers or nickel base alloy for high temperature spiral heat exchangers.

The outer ends of the two sheets of metal are joined to the last turn, or wrap, of the sheets to provide a seal to prevent pressurised fluid leaking out of the spiral heat exchanger. Additionally external attachments have to be secured to the axial ends of the spiral heat exchanger.

One problem with the manufacture of the spiral heat exchangers is sealing the outer ends of the metal sheets and at the same time allowing external attachments to be secured to the axial ends of the spiral heat exchanger.

One possible alternative is to provide an axially extending sealing weld between the outer ends of the two sheets of metal and the last turn, or wrap, of the sheets to provide the seal and then providing circumferentially extending welds between the axial ends of the spiral heat exchanger and two thicker metal rings. However, it is difficult to provide an axially extending sealing weld between two relatively thin metal sheets and the weld may blow through the sheet underneath to produce a hole and scrap the spiral heat exchanger. Also, it is difficult to provide the circumferentially extending welds between relatively thick metal rings and relatively thin metal sheets, because the heat transmitted from the relatively thick metal rings is likely to overheat the relatively thin metal sheets and produce a hole. Furthermore, the fit between the metal rings and the axial ends of the spiral heat exchanger is important and the circumferences have to match perfectly to achieve good circumferentially extending welds.

SUMMARY OF THE INVENTION

Accordingly the present invention seeks to provide a novel heat exchanger, which reduces, preferably overcomes, the above-mentioned problems.

Accordingly the present invention provides a heat exchanger having a hot end and a cold end, the hot and cold ends of the heat exchanger being arranged at the axial ends of the heat exchanger, the heat exchanger comprising a first sheet, a second sheet and at least one additional sheet, the first and second sheets being wound around an axis, each sheet having hot and cold edges at the hot and cold ends respectively of the heat exchanger, the hot and cold edges of the first sheet being joined to the hot and cold edges respectively of the second sheet, the end of the first sheet being joined to the second sheet by an axially extending join at a position spaced from the end of the second sheet, the at least one additional sheet being joined to the end of the second sheet, the at least one additional sheet being thicker and wider than the first and second sheets such that at least one of the hot and cold edges of the at least one additional sheet extend beyond the hot and cold edges of the first and second sheets, the at least one additional sheet being wound around the first and second sheets about the axis, the end of the at least one additional sheet being joined to the at least one additional sheet by an axially extending join.

Preferably the hot and cold edges of the at least one additional sheet extend beyond the hot and cold edges of the first and second sheets.

Preferably a ring is joined to the at least one of the hot and cold edges of the at least one additional sheet.

Preferably a first ring is joined to the hot edge of the at least one additional sheet and a second ring is joined to the cold edge of the at least one additional sheet.

Preferably the join between the hot and cold edges of the first and second sheets are joined by welded joints, brazed joints, bonded joints crimped joints or glued joints.

Preferably the axially extending joint between the end of the first sheet and the second sheet is a welded joint, a brazed joint or a bonded joint.

Preferably the axially extending joint between the end of the second sheet and the at least one additional sheet is a welded joint, a brazed joint or a bonded joint.

Preferably the joint between the ring and the hot or cold end of the at least one additional sheet is a welded joint, a brazed joint or a bonded joint.

The at least one additional sheet may comprise a single sheet. Alternatively the at least one additional sheet comprises a plurality of sheets, adjacent additional sheets have different thicknesses and/or widths. A first end of a first one of the additional sheets is joined to the end of the second sheet, a second end of the first one of the additional sheets is joined to a first end of a second one of the additional sheets by an axially extending join and a second end of the second one of the additional sheets is joined to the second one of the additional sheets by an axially extending join.

The heat exchanger may be a primary surface heat exchanger. Alternatively the heat exchanger may be a plate fin heat exchanger. At least one corrugated sheet may be arranged between the first and second sheets.

Preferably the first sheet comprises a metal or alloy. Preferably the second sheet comprises a metal or alloy. Preferably the third sheet comprises a metal or alloy. Preferably the alloy comprises a nickel base alloy or a steel. Preferably the steel comprises stainless steel.

The second metal sheet may be the radially outer metal sheet or the radially inner metal sheet.

Preferably the heat exchanger is a spiral heat exchanger.

The present invention also provides a method of manufacturing a heat exchanger, the heat exchanger having a hot end and a cold end, the hot and cold ends of the heat exchanger being arranged at the axial ends of the heat exchanger, comprising forming a first sheet, forming a second sheet and forming at least one additional sheet, winding the first and second sheets around an axis, each sheet having hot and cold edges at the hot and cold ends respectively of the heat exchanger, joining the hot and cold edges of the first sheet to the hot and cold edges respectively of the second sheet, joining the end of the first sheet to the second sheet by an axially extending join at a position spaced from the end of the second sheet, joining the at least one additional sheet to the end of the second sheet, the at least one additional sheet being thicker and wider than the first and second sheets such that at least one of the hot and cold edges of the at least one additional sheet extend beyond the hot and cold edges of the first and second sheets, winding the at least one additional sheet around the first and second sheets about the axis, joining the end of the at least one additional sheet to the at least one additional sheet by an axially extending join.

Preferably the method comprises arranging the hot and cold edges of the at least one additional sheet to extend beyond the hot and cold edges of the first and second sheets.

Preferably the method comprises joining a ring to the at least one of the hot and cold edges of the at least one additional sheet.

Preferably the method comprises joining a first ring to the hot edge of the third sheet and joining a second ring to the cold edge of the at least one additional sheet.

Preferably the method comprises joining the hot and cold edges of the first and second sheets by welded joints, brazed joints, bonded joints crimped joints or glued joints.

Preferably the method comprises forming the axially extending joint between the end of the first sheet and the second sheet using a welded joint, a brazed joint or a bonded joint.

Preferably the method comprises forming the axially extending joint between the end of the second sheet and the at least one additional sheet using a welded joint, a brazed joint or a bonded joint.

Preferably the method comprises forming the joint between the ring and the hot or cold end of the at least one additional sheet using a welded joint, a brazed joint or a bonded joint.

The at least one additional sheet may comprise a single sheet. Alternatively the at least one additional sheet comprises a plurality of sheets, adjacent additional sheets have different thicknesses and/or widths. The method may comprise joining a first end of a first one of the additional sheets to the end of the second sheet, joining a second end of the first one of the additional sheets to a first end of a second one of the additional sheets by an axially extending join and joining a second end of the second one of the additional sheets to the second one of the additional sheets by an axially extending join.

The heat exchanger may be a primary surface heat exchanger. Alternatively the heat exchanger may be a plate fin heat exchanger. The method may comprise placing at least one corrugated sheet between the first and second sheets and winding the first and second sheets and the at least one corrugated sheet into a spiral.

Preferably the method comprises forming the first sheet from a metal or alloy. Preferably the method comprises forming the second sheet from a metal or alloy. Preferably the method comprises forming the third sheet from a metal or alloy. Preferably the alloy comprises a nickel base alloy or a steel. Preferably the steel comprises stainless steel.

Preferably the first and second sheets are wound into a spiral to form a spiral heat exchanger.

BRIEF DESCRIPTION OF THE DRAWINGS

The present invention will be more fully described by way of example with reference to the accompanying drawings in which.

DETAILED DESCRIPTION OF THE INVENTION

Figure 1:
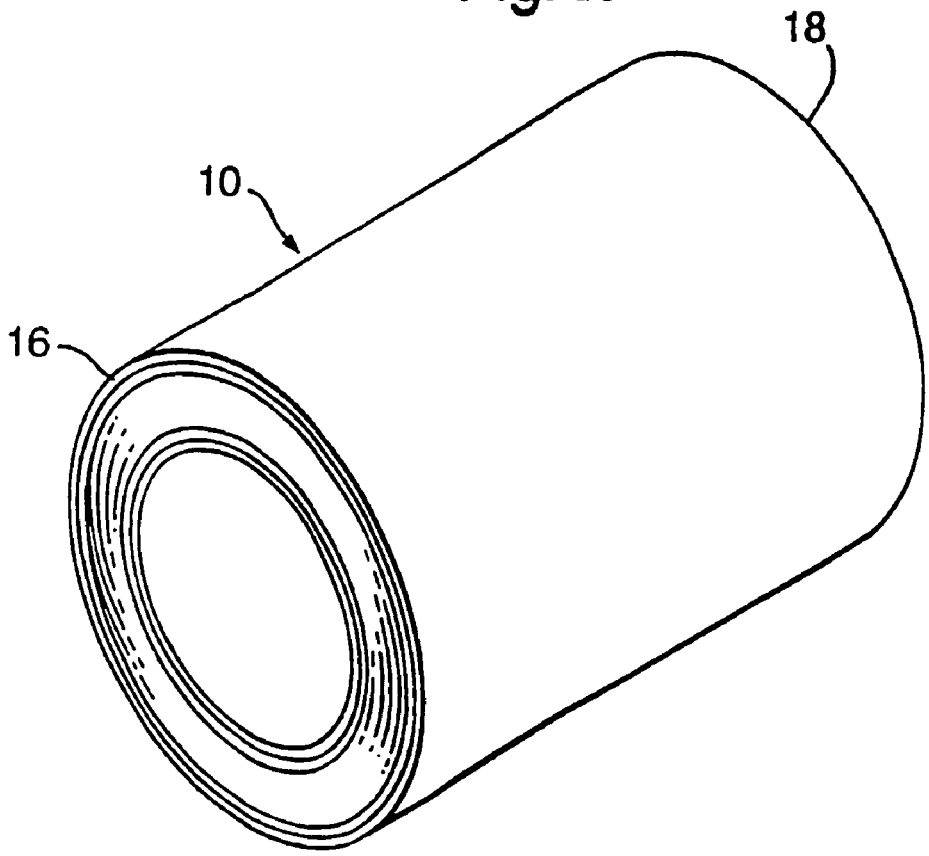
FIG. 1 shows a heat exchanger according to the present invention.
Figure 2:
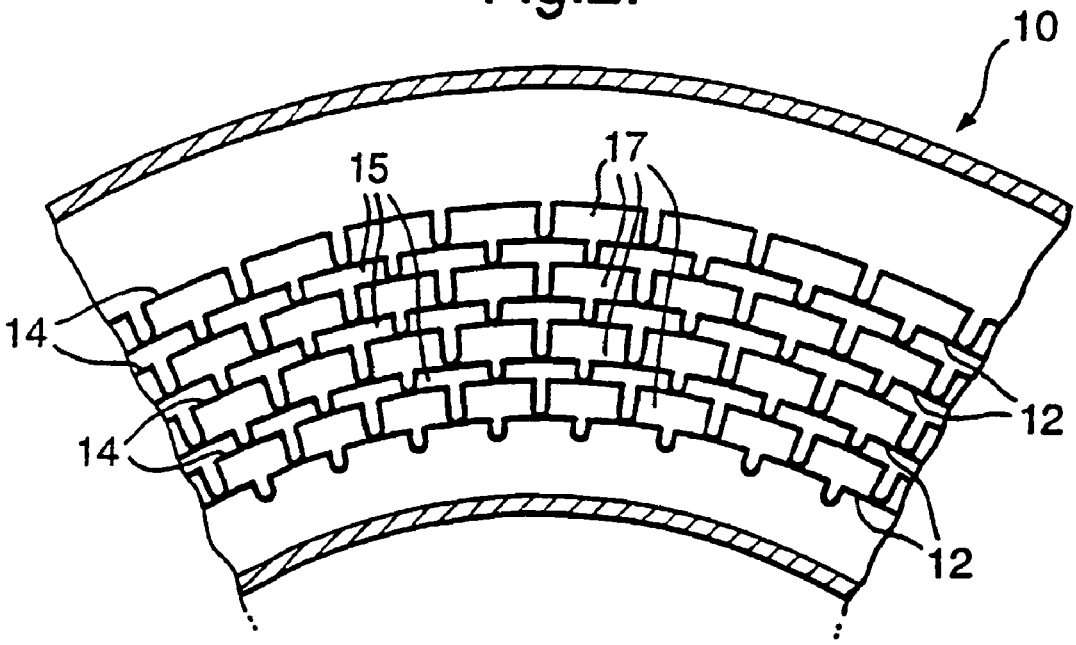
FIG. 2 is a radial cross-sectional view through the heat exchanger shown in FIG. 1.
Figure 3:
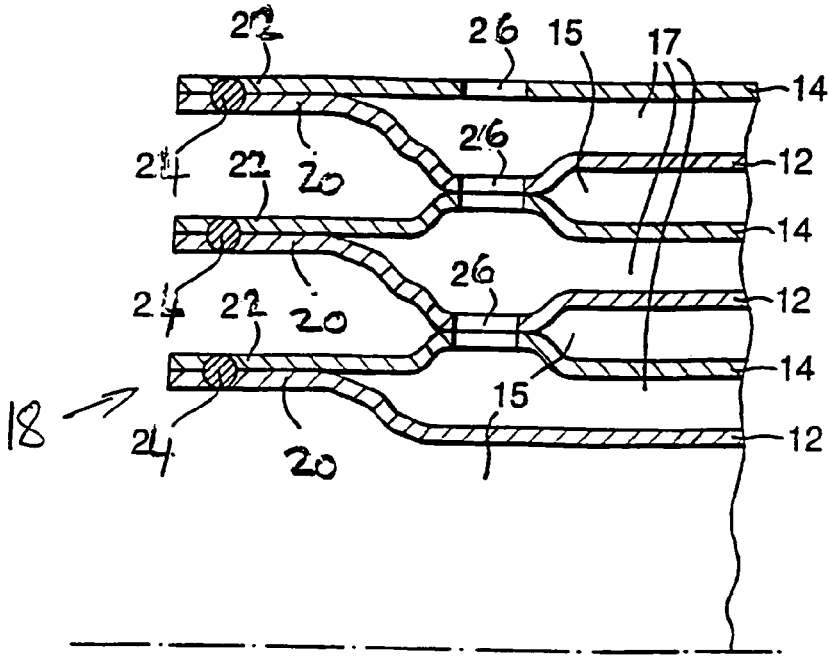
FIG. 3 is an enlarged axial cross-sectional view through a portion of the heat exchanger shown in FIGS. 1 and 2.

A spiral heat exchanger 10 suitable for a gas turbine engine intercooler, regenerator or recuperator is shown in FIGS. 1, 2 and 3. The spiral heat exchanger 10 is annular and comprises a first metal sheet 12 and a second metal sheet 14, which are arranged in a spiral. The spiral heat exchanger 10 has a hot end 16 and a cold end 18 at opposite axial ends of the spiral heat exchanger 10. A first, relatively hot, fluid is supplied to the hot end 16 of the spiral heat exchanger 10 and the first fluid is removed from the cold end 18 of the spiral heat exchanger 10.

The first and second metal sheets 12 and 14 respectively form a primary surface type heat exchanger, as shown in FIG. 2. The first fluid is supplied to an axially extending passage 15 defined between two confronting surfaces of the first and second metal sheets 12 and 14 respectively. A second fluid is supplied to an axially extending passage 17 defined between the other two confronting surfaces of the first and second metal sheets 12 and 14 respectively.

Figure 4:
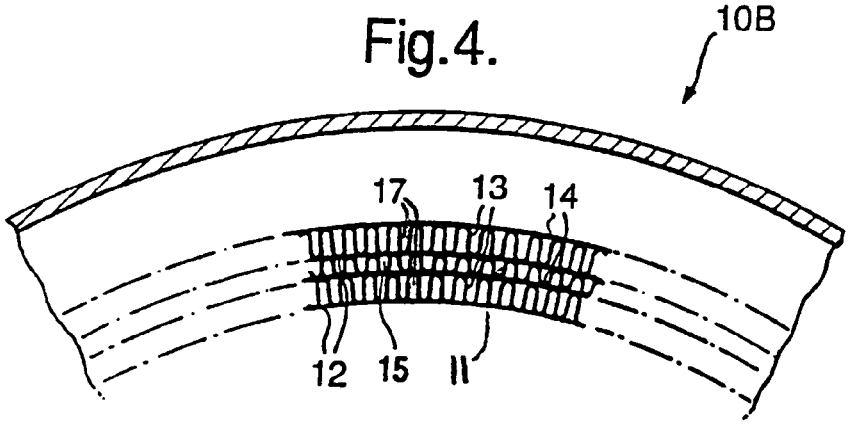
FIG. 4 is an alternative radial cross-sectional view through the heat exchanger shown in FIG. 1.

Alternatively the first and second metal sheets 12 and 14 respectively may form a plate fin type heat exchanger 10B as shown in FIG. 4. The first fluid is supplied to axially extending passages 15 defined by a corrugated sheet 11 between the two confronting surfaces of the first and second metal sheets 12 and 14 respectively. A second fluid is supplied to axially extending passages 17 defined by a corrugated sheet 13 between the other two confronting surfaces of the first and second metal sheets 12 and 14 respectively.

Figure 5:
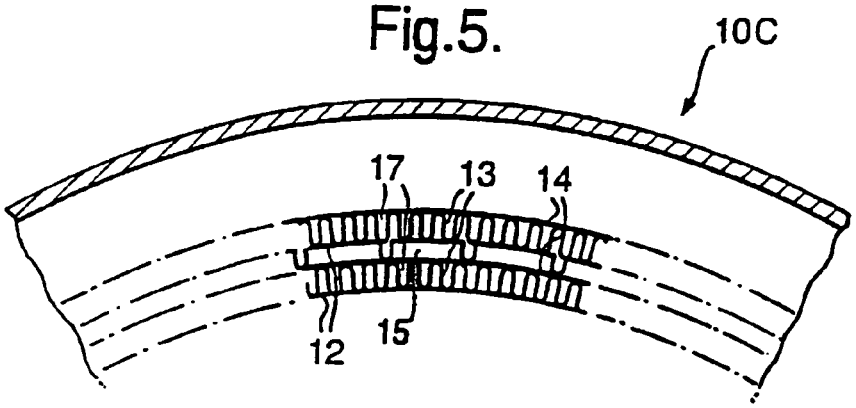
FIG. 5 is a further alternative radial cross-sectional view through the heat exchanger shown in FIG. 1.

Alternatively the first and second metal sheets 12 and 14 respectively may form a combination of a plate type and a plate fin type heat exchanger 10C as shown in FIG. 5. The first fluid is supplied to axially extending passage 15 defined between the two confronting surfaces of the first and second metal sheets 12 and 14 respectively. A second fluid is supplied to axially extending passages 17 defined by a corrugated sheet 13 between the other two confronting surfaces of the first and second metal sheets 12 and 14 respectively.

The first metal sheet 12 is radially within the second metal sheet 14 at each respective turn around the axis X of the spiral heat exchanger 10, as shown in FIG. 3. The first metal sheet 12 has a hot edge 20 and a cold edge at the hot and cold ends 16 and 18 respectively of the spiral heat exchanger 10. The second metal sheet 14 has a hot edge 22 and a cold edge at the hot and cold ends 16 and 18 respectively of the spiral heat exchanger 10. The hot edges 20 and 22 of the first and second metal sheets 12 and 14 are joined together to form a seal by a spiral joint 24.

The joint 24 may be a welded joint, a brazed joint, a bonded joint, a crimped joint or a glued joint. The cold edges of the first and second metal sheets 12 and 14 are joined together to form a seal by a spiral joint. The joint may be a welded joint, a brazed joint, a bonded joint, a crimped joint or a glued joint.

Preferably the second fluid is supplied to the axially extending passage 17 by one or more apertures, passages or manifolds 26 extending radially through the first and second metal sheets 12 and 14 at one axial end of the spiral heat exchanger 10 as shown in FIG. 3. Similarly the second fluid may be removed from the axially extending passage 17 by one or more apertures, passages or manifolds extending radially through the first and second metal sheets 12 and 14 at the other axial end of the spiral heat exchanger 10. This is described more fully in our European patent EP0753712B1.

Alternatively the second fluid is supplied to the axially extending passage 17 by one or more manifolds (not shown) extending radially at one axial end of the spiral heat exchanger 10. Similarly the second fluid is removed from the axially extending passage 17 by one or more manifolds (not shown) extending radially at the other axial end of the spiral heat exchanger 10. These radially extending manifolds supply or remove the second fluid through radially extending, angularly spaced, zones or sectors, where the hot and cold edges are not joined together to allow the flow of the second fluid axially into or out of the axially extending passage 17. The hot and cold edges may have pieces cut away or pieces bent to allow this. This is described more fully in European patent EP0798527B1.

The first and second metal sheets preferably have a thickness of 0.05 mm to 1 mm, more preferably a thickness of 0.1 mm to 0.25 mm.

As mentioned previously it is necessary to seal the ends of the first and second metal sheets 12 and 14 to a previous turn, or wrap, of the first and/or second metal sheets 12 and 14.

Figure 6:
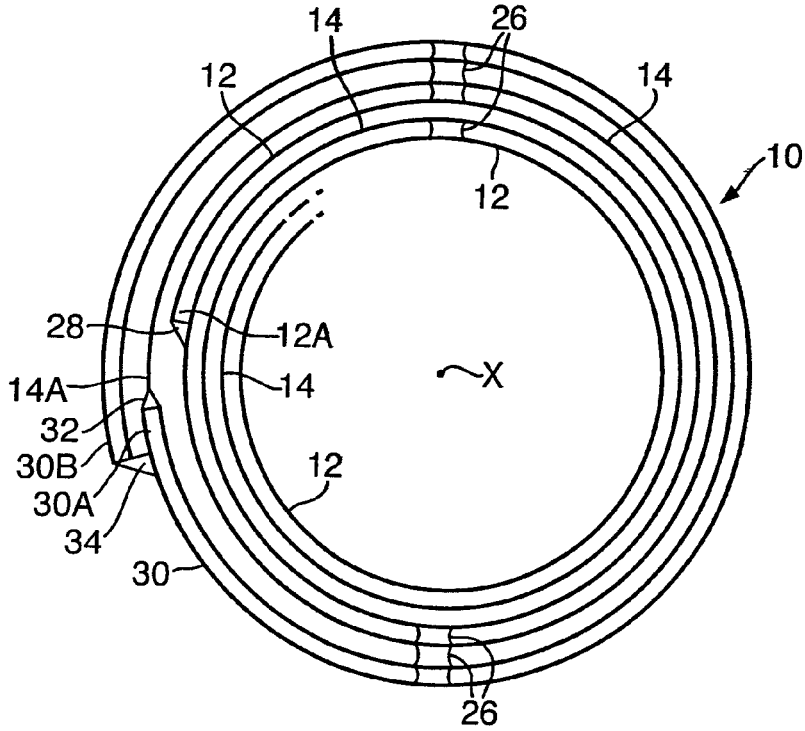
FIG. 6 is an enlarged axial end view of a portion of the heat exchanger shown in FIGS. 1, 2 and 3.
Figure 7:
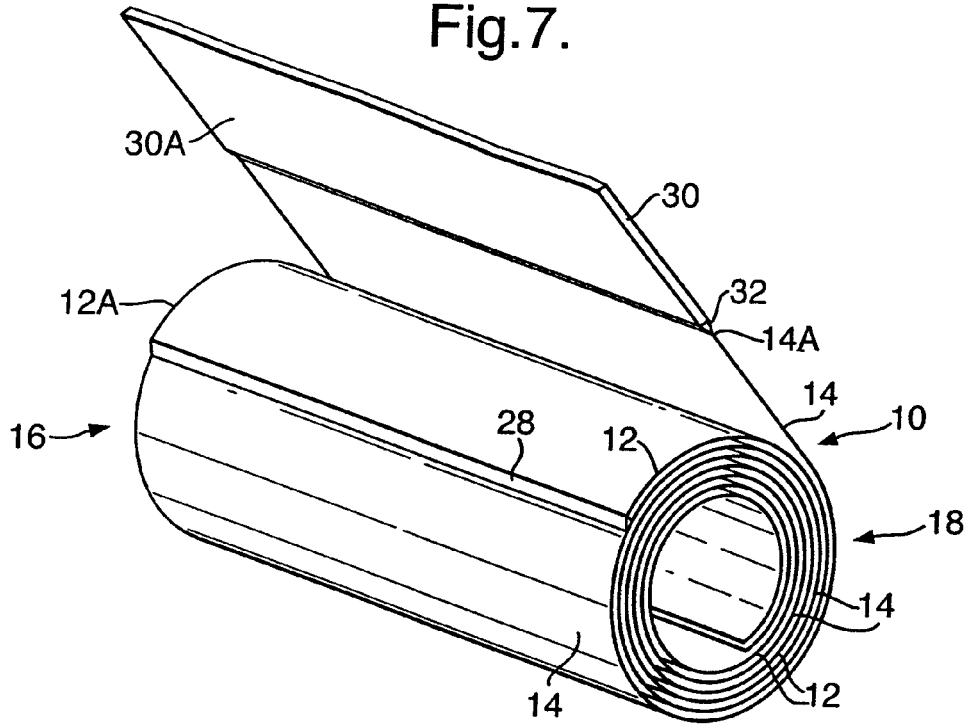
FIG. 7 is a perspective view of the heat exchanger at one stage of the manufacturing process.

In the present invention the end 12A of the first metal sheet 12 is joined to the previous turn of the second metal sheet 14, by an axially extending join 28, to form a seal, as shown in FIGS. 6 and 7. The axially extending join 28 is at a position of the second metal sheet 14 spaced from the end 14A of the second metal sheet 14. In this example the axially extending join 28 is at least one turn away from the end 14A of the second metal sheet 14. The axially extending joint 28 may be a welded joint, a brazed joint or a bonded joint.

The end of the second metal sheet is joined to an end of one or more additional metal sheets. In this example the end 14A of the second metal sheet 14 is joined to an end 30A of a third metal sheet 30, by an axially extending join 32, to form a seal also shown in FIGS. 6 and 7. The axially extending join 32 may be a welded joint, a brazed joint or a bonded joint. It is to be noted that the third metal sheet 30 is thicker than the first and second metal sheets 12 and 14 respectively and the third metal sheet 30 is wider than the first and second metal sheets 12 and 14 respectively. The third metal sheet preferably has a thickness of 0.4 mm to 1.0 mm. The hot and cold edges of the third metal sheet 30 extend beyond the hot and cold edges of the first and second metal sheets 12 and 14 respectively. Preferably the hot and cold edges of the third metal sheet 30 are the same distance from the hot and cold edges of the first and second metal sheets 12 and 14 respectively, however they need not be.

Figure 8:
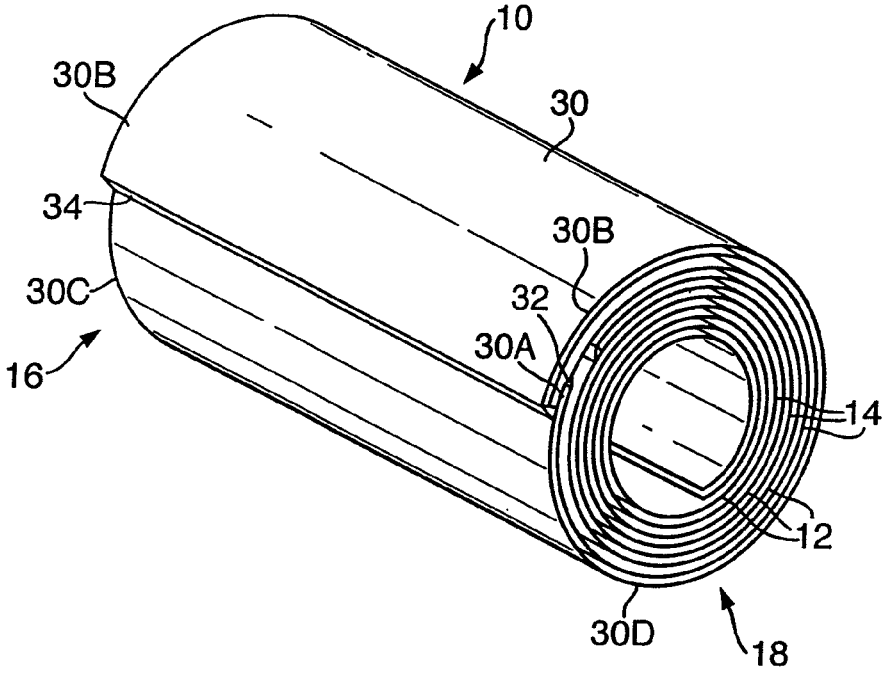
FIG. 8 is a further perspective view of the heat exchanger at a further stage of the manufacturing process.

The third metal sheet 30 is wound around the first and second metal sheets 12 and 14 about the axis X for at least one full turn and then the end 30B of the third metal sheet 30 is joined to the previous turn of the third metal sheet 30, by an axially extending join 34, to form a seal, as shown in FIGS. 6 and 8. The joint 34 may be a welded joint, a brazed joint or a bonded joint.

Figure 9:
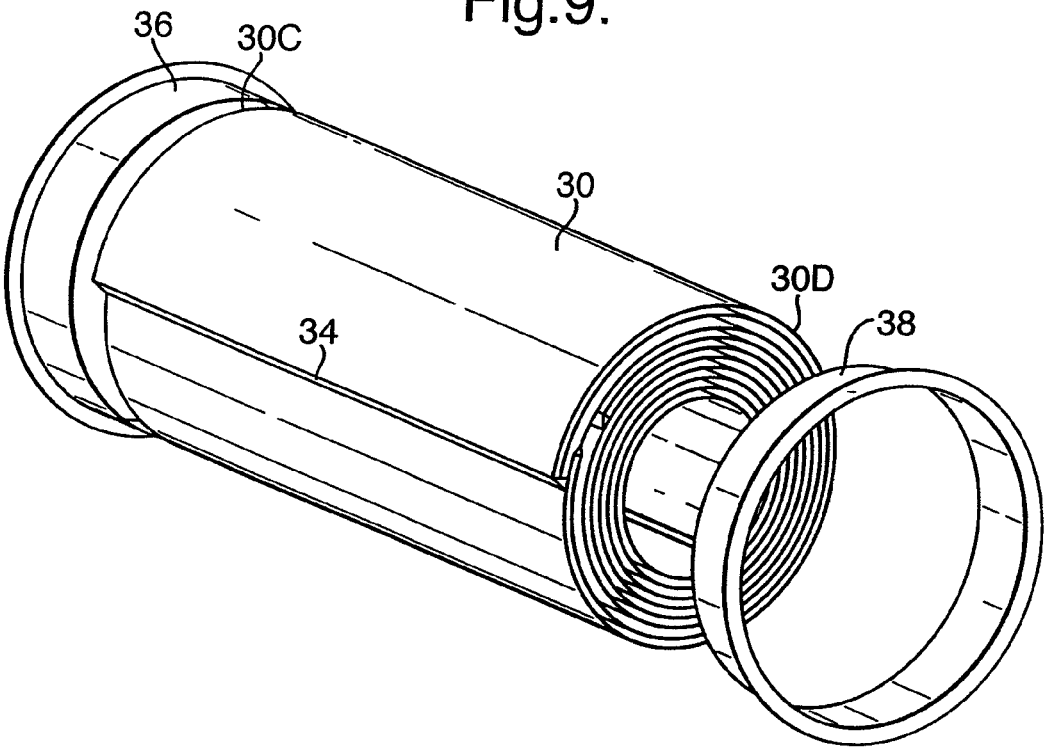
FIG. 9 is another perspective view of the heat exchanger at a further stage of the manufacturing process.
Figure 10:
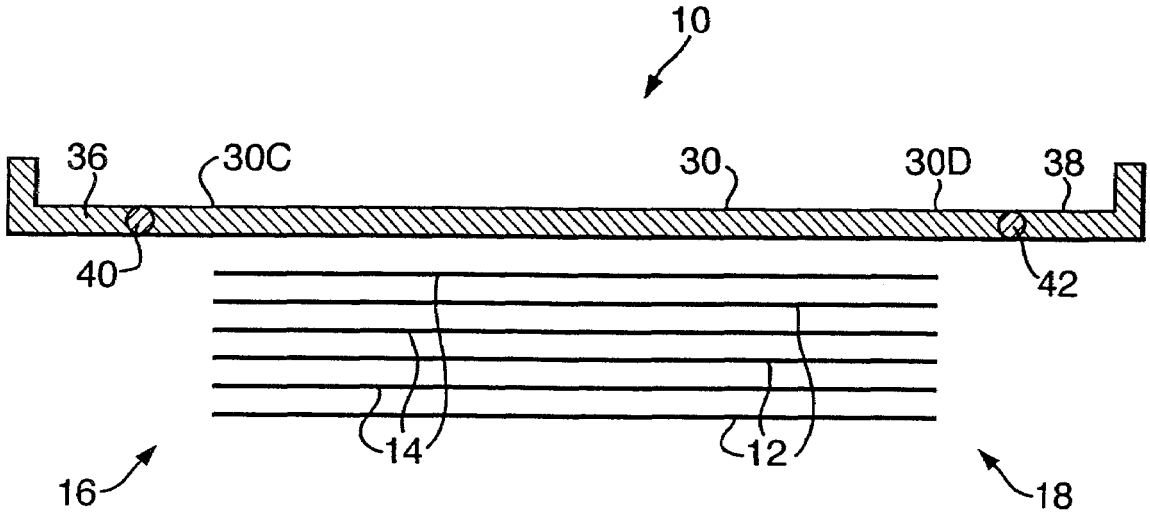
FIG. 10 is an axial cross-sectional view through the heat exchanger shown in FIG. 9.

Then first and second metal rings 36 and 38 are joined to the hot and cold ends 30C and 30D of the third metal sheet 30 by circumferentially extending joins 40 and 42 as shown in FIGS. 9 and 10. The first and second metal rings 36 and 38 have substantially the same thickness as the third metal sheet 30. The joints 40 and 42 may be welded joints, brazed joints or bonded joints. The first and second metal rings 36 and 38 provide areas for external attachments to be secured to the spiral heat exchanger 10.

As an alternative the third metal sheet 30 may be sufficiently wide as to provide areas for external attachments without the use of the first and second metal rings.

As a further alternative several additional metal sheets are joined to the end of the second metal sheet. For example the end of the second metal sheet is joined to a third metal sheet, by an axially extending join, to form a seal. The axially extending joint may be a welded joint, a brazed joint or a bonded joint. It is to be noted that the third metal sheet is thicker than the first and second metal sheets and the third metal sheet is wider than the first and second metal sheets. The third metal sheet preferably has a thickness of 0.4 mm to 1.0 mm. The hot and cold edges of the third metal sheet extend beyond the hot and cold edges of the first and second metal sheets. The hot and cold edges of the third metal sheet are the same distance from the hot and cold edges of the first and second metal sheets, however they need not be.

The end of the third metal sheet is joined to a fourth metal sheet, by an axially extending join, to form a seal. The axially extending joint may be a welded joint, a brazed joint or a bonded joint. It is to be noted that the fourth metal sheet is thicker and wider than the third metal sheet. The fourth metal sheet preferably has a thickness of 0.4 mm to 1.0 mm. The hot and cold edges of the fourth metal sheet extend beyond the hot and cold edges of the third metal sheet. The hot and cold edges of the fourth metal sheet are the same distance from the hot and cold edges of the third metal sheet, however they need not be.

The third and fourth metal sheets are wound around the first and second metal sheets about the axis for at least one full turn of the fourth metal sheet and then the end of the fourth metal sheet is joined to the previous turn of the fourth metal sheet, by an axially extending join, to form a seal. The joint may be a welded joint, a brazed joint or a bonded joint. The use of the third and fourth metal sheets allows a more gradual increase in thickness and width, because sudden changes in thickness and/or width give rise to high stresses at the join.

First and second metal rings are joined to the hot and cold ends of the fourth metal sheet by circumferentially extending joins. The first and second rings have substantially the same thickness as the fourth metal sheet. The joints may be welded joints, brazed joints or bonded joints. The first and second metal rings provide areas for external attachments to be secured to the spiral heat exchanger.

As an alternative the fourth metal sheet may be sufficiently wide as to provide areas for external attachments without the use of the first and second metal rings.

The welded joints may be produced by any suitable welding process foe example TIG welding, MIG welding, laser welding, electron beam welding etc.

The advantages of the present invention are that the circumferentially extending joints between the first and second metal rings and the relatively thin first and second metal sheets are removed. The joints between thick end rings and the relatively thin first and second metal sheets are believed to give rise to stresses between the thick and thin components due to the axial change in thickness. The final axially extending joint is not between the relatively thin first and/or second metal sheets, but is between different regions of the relatively thick third metal sheet or is between different regions of the relatively thick fourth metal sheet and this joint is easier to produce without forming a hole. The joint between the second metal sheet and the third metal sheet and the joint between the third metal sheet and the fourth metal sheet may be inspected from either side before the third metal sheet or third and fourth metal sheets are wound around the first and second metal sheets, if it necessary to reform the joint should it be unsatisfactory.

Although the present invention has been described with reference to joining the third metal sheet to the end of the radially outer metal sheet, it may be possible to join the third metal sheet to the end of the radially inner metal sheet.

Although the present invention has been described with reference to a recuperator, the present invention may be applied to an intercooler or other type of heat exchanger. Although the present invention has been described with reference to a gas turbine engine heat exchanger, the present invention may be applicable to heat exchangers for other engines or other purposes.

Although the present invention has been described with reference to metal sheets the present invention may be applied to other sheets, for example plastic sheets or ceramic sheets.

Although the present invention has described the whole of both of the hot and cold edges of the first metal sheet being joined to the hot and cold edges of the second metal it may be possible for only one or more portions of the hot and cold edges of the first metal sheet to be joined to the hot and cold edges of the second metal sheet.

Although the present invention has been described with reference to a spiral heat exchanger, the spiral heat exchanger includes heat exchangers in which the sheets are wound, or formed or bent, around an axis to form a smoothly curved structure or a polygonal structure, for example square, hexagonal, octagonal etc structures.

The invention claimed is:

1. A method of manufacturing a heat exchanger, the heat exchanger having a hot end and a cold end, the hot and cold ends of the heat exchanger being arranged at the axial ends of the heat exchanger, comprising forming a first sheet, forming a second sheet and forming at least one additional sheet, winding the first and second sheets around an axis, each sheet having hot and cold edges at the hot and cold ends respectively of the heat exchanger, joining the hot and cold edges of the first sheet to the hot and cold edges respectively of the second sheet, joining an end of the first sheet to the second sheet by an axially extending join at a position spaced at least one turn away from an end of the second sheet, joining the at least one additional sheet to the end of the second sheet, the at least one additional sheet being thicker and wider than the first and second sheets such that at least one of the hot and cold edges of the at least one additional sheet extend beyond the hot and cold edges of the first and second sheets, winding the at least one additional sheet around the first and second sheets about the axis, joining the end of the at least one additional sheet to the at least one additional sheet by an axially extending join, wherein the at least one additional sheet comprises a plurality of sheets, adjacent additional sheets have different thicknesses and/or widths.

2. A method as claimed in claim 1 comprising arranging the hot and cold edges of the at least one additional sheet to extend beyond the hot and cold edges of the first and second sheets.

3. A method as claimed in claim 1 comprising joining the hot and cold edges of the first and second sheets by welded joints, brazed joints, bonded joints crimped joints or glued joints.

4. A method as claimed in claim 1 comprising forming the axially extending joint between the end of the first sheet and the second sheet using a welded joint, a brazed joint or a bonded joint.

5. A method as claimed in claim 1 wherein the heat exchanger is a primary surface heat exchanger.

6. A method as claimed in claim 1 wherein the heat exchanger is a plate fin heat exchanger.

7. A method as claimed in claim 6 comprising placing at least one corrugated sheet between the first and second sheets and winding the first and second sheets and the at least one corrugated sheet into a spiral.

8. A method as claimed in claim 1 comprising forming the first sheet from a metal or alloy.

9. A method as claimed in claim 1 comprising forming the second sheet from a metal or alloy.

10. A method as claimed in claim 8 wherein the alloy comprises a nickel base alloy or a steel.

11. A method as claimed in claim 1 comprising forming the third sheet from a metal or alloy.

12. A method as claimed in claim 10 wherein the steel comprises stainless steel.

13. A method as claimed in claim 1 wherein the first and second sheets are wound into a spiral to form a spiral heat exchanger.

14. A method of manufacturing a heat exchanger, the heat exchanger having a hot end and a cold end, the hot and cold ends of the heat exchanger being arranged at the axial ends of the heat exchanger, comprising forming a first sheet, forming a second sheet and forming at least one additional sheet, winding the first and second sheets around an axis, each sheet having hot and cold edges at the hot and cold ends respectively of the heat exchanger, joining the hot and cold edges of the first sheet to the hot and cold edges respectively of the second sheet, joining the end of the first sheet to the second sheet by an axially extending join at a position spaced from the end of the second sheet, joining the at least one additional sheet to the end of the second sheet, the at least one additional sheet being thicker and wider than the first and second sheets such that at least one of the hot and cold edges of the at least one additional sheet extend beyond the hot and cold edges of the first and second sheets, winding the at least one additional sheet around the first and second sheets about the axis, joining the end of the at least one additional sheet to the at least one additional sheet by an axially extending join, characterised in that the at least one additional sheet comprises a plurality of sheets, adjacent additional sheets have different thicknesses and/or widths, wherein the method comprises joining a ring to the at least one of the hot and cold edges of the at least one additional sheet.

15. A method as claimed in claim 14 comprising joining a first ring to the hot edge of the at least one additional sheet and joining a second ring to the cold edge of the at least one additional sheet.

16. A method as claimed in claim 14 comprising forming the joint between the ring and the hot or cold end of the at least one additional sheet using a welded joint, a brazed joint or a bonded joint.

17. A method of manufacturing a heat exchanger, the heat exchanger having a hot end and a cold end, the hot and cold ends of the heat exchanger being arranged at the axial ends of the heat exchanger, comprising forming a first sheet, forming a second sheet and forming at least one additional sheet, winding the first and second sheets around an axis, each sheet having hot and cold edges at the hot and cold ends respectively of the heat exchanger, joining the hot and cold edges of the first sheet to the hot and cold edges respectively of the second sheet, joining the end of the first sheet to the second sheet by an axially extending join at a position spaced from the end of the second sheet, joining the at least one additional sheet to the end of the second sheet, the at least one additional sheet being thicker and wider than the first and second sheets such that at least one of the hot and cold edges of the at least one additional sheet extend beyond the hot and cold edges of the first and second sheets, winding the at least one additional sheet around the first and second sheets about the axis, joining the end of the at least one additional sheet to the at least one additional sheet by an axially extending join, characterised in that the at least one additional sheet comprises a plurality of sheets, adjacent additional sheets have different thicknesses and/or widths, wherein the method comprises forming the axially extending joint between the end of the second sheet and the at least one additional sheet using a welded joint, a brazed joint or a bonded joint.

18. A method of manufacturing a heat exchanger, the heat exchanger having a hot end and a cold end, the hot and cold ends of the heat exchanger being arranged at the axial ends of the heat exchanger, comprising forming a first sheet, forming a second sheet and forming at least one additional sheet, winding the first and second sheets around an axis, each sheet having hot and cold edges at the hot and cold ends respectively of the heat exchanger, joining the hot and cold edges of the first sheet to the hot and cold edges respectively of the second sheet, joining the end of the first sheet to the second sheet by an axially extending join at a position spaced from the end of the second sheet, joining the at least one additional sheet to the end of the second sheet, the at least one additional sheet being thicker and wider than the first and second sheets such that at least one of the hot and cold edges of the at least one additional sheet extend beyond the hot and cold edges of the first and second sheets, winding the at least one additional sheet around the first and second sheets about the axis, joining the end of the at least one additional sheet to the at least one additional sheet by an axially extending join, characterised in that the at least one additional sheet comprises a plurality of sheets, adjacent additional sheets have different thicknesses and/or widths, wherein the method comprises joining a first end of a first one of the additional sheets to the end of the second sheet, joining a second end of the first one of the additional sheets to a first end of a second one of the additional sheets by an axially extending join and joining a second end of the second one of the additional sheets to the second one of the additional sheets by an axially extending join.

* * * * *

UNITED STATES PATENT AND TRADEMARK OFFICE

CERTIFICATE OF CORRECTION

PATENT NO. : 7,600,316 B2
APPLICATION NO. : 11/342974
DATED : October 13, 2009
INVENTOR(S) : James I Oswald It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 468 days.

Signed and Sealed this

Fifth Day of October, 2010

David J. Kappos

David J. Kappos
*Director of the United States Patent and Trademark Office*